United States Patent [19]

Page

[11] 4,242,940

[45] Jan. 6, 1981

[54] FLUID OPERATED CONTROL DEVICE

[76] Inventor: Victor J. Page, 47 Westmiston Ave., Saltdean, Sussex, England

[21] Appl. No.: 842,791

[22] Filed: Oct. 17, 1977

[30] Foreign Application Priority Data

May 30, 1977 [GB] United Kingdom ..... 22742/77

[51] Int. Cl.[2] ..... F01L 31/14; F01L 25/06

[52] U.S. Cl. ..... 91/277; 91/306

[58] Field of Search ..... 91/306, 277, 330, 305

[56] References Cited

U.S. PATENT DOCUMENTS

| | | | |
|---|---|---|---|
| 1,089,718 | 3/1914 | Metzelaar | 91/277 |
| 3,563,273 | 2/1971 | Mills | 91/306 |
| 3,707,881 | 1/1973 | Neuhaus | 91/306 |
| 3,943,823 | 3/1976 | Tammy | 91/306 |

FOREIGN PATENT DOCUMENTS

| | | | |
|---|---|---|---|
| 2357604 | 5/1975 | Fed. Rep. of Germany | 91/306 |

*Primary Examiner*—Paul E. Maslousky

*Attorney, Agent, or Firm*—Fitch, Even & Tabin

[57] ABSTRACT

A fluid operated control device which co-operates with reciprocating means, such as a pneumatically driven shaft. The device includes a main cylinder and piston backed at each end by valves which each include auxiliary cylinders and pistons. The valves provide signal inlets and outlets which can be cross connected to cause continuous reciprocation of the main piston. Alternatively, the valves are operated to displace the main piston selectively or are connected to a delay to vary the timing sequence. Stroke adjustment is possible by a rod attached to one of the auxiliary valves. The main piston is mounted on a shaft passing through the other auxiliary valves.

10 Claims, 5 Drawing Figures

Figure 1:
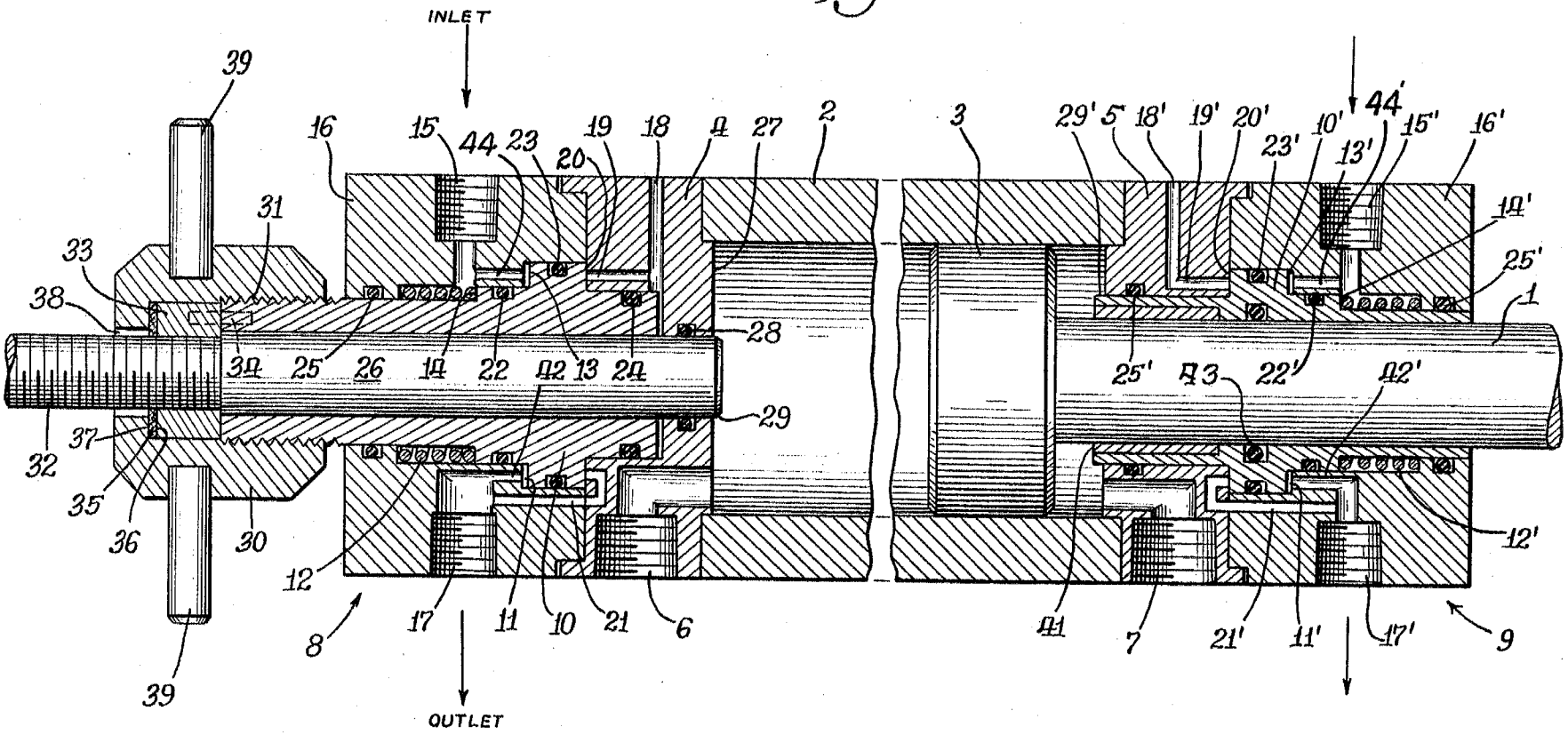

Fig. 2.
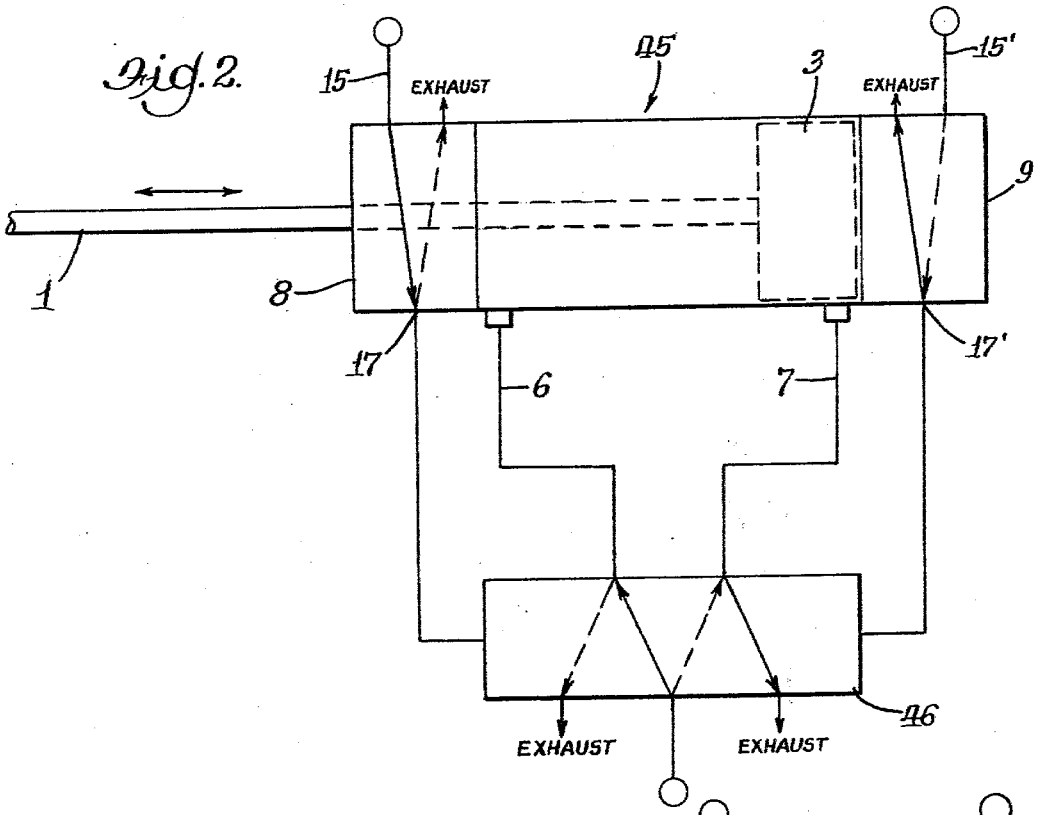
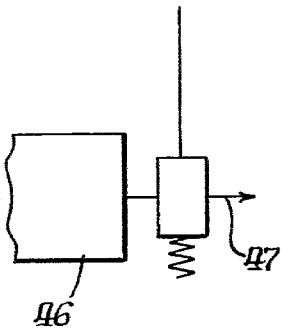
Fig. 3.
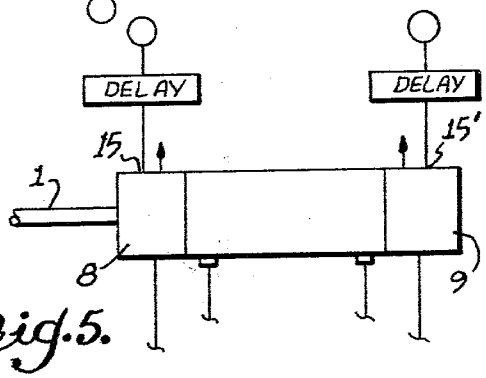
Fig. 5.
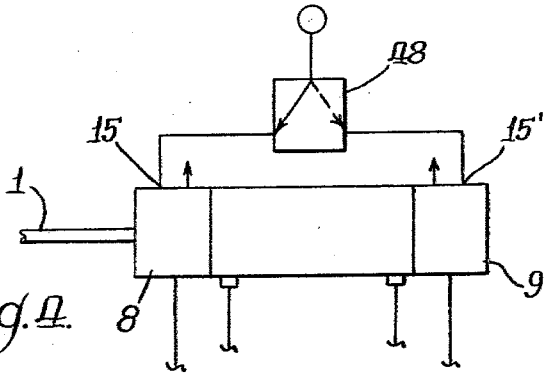
Fig. 4.

FLUID OPERATED CONTROL DEVICE

This invention relates to a fluid operated control device which co-operates with reciprocating means.

In the food industry, the invention is particularly useful with metering pumps which are used for dispensing predetermined quantities of liquids, semi-fluids such as gels (which may be viscous or non-viscous), suspensions wherein particles or pieces of food are contained in a liquid or semi-fluid carrier (such as meat in gravy, strawberries and cream) or other similar products. In a metering pump, a shaft or push rod attached to a piston in a metering cylinder forms the reciprocating means.

The invention may be applied more widely in, for example, the field of automatic machine control wherein pneumatic or hydraulic valves are used in controlling a machine sequence or sub-sequence.

In the field of mass produced food products, containers such as cans, cartons, bottles or baked cases may be filled with what is generally termed "a fluid product". It is important to provide an accurate metering pump capable of operating at high speed to fill each container with a predetermined quantity of food. In a discontinuous conveyor line, the containers are intermittently advanced past a filling station at which one or more metering pumps are located. Generally, the or each pump contains a reciprocating piston which draws in and expels the metered quantity of food. It is important to determine the position of the piston at each end of its stroke in order to control, for example, the advancing of the conveyor belt. As the length of stroke determines the quantity of product dispensed (with regard to the swept volume of the metering cylinder), it is necessary to provide some means for controlling the stroke length of the piston to control or adjust the amount of produce dispensed.

In a typical installation, a single cylinder has a product dispensing section, which defines a first or metering cylinder, and a drive section, which defines a second cylinder supplied with compressed air. First and second pistons, in the respective first and second cylinders, are connected in tandem by a common shaft. Compressed air is supplied to the second cylinder to reciprocate the second, and hence the first piston. Trip or limit switches are positioned in the path of movement of an extension of the shaft to provide signals for respective and independent pilot valves. The pilot valves are connected to one or more shuttle spool valves which control the flow of air to the second cylinder in the drive section and which control the operating sequence and conveyor advance. The length of stroke is usually adjusted by a screwed stop which abuts the second piston in the drive section. When the stop is adjusted, the trip or limit switches require repositioning or adjustment so that they respond in a correct timing sequence, to the adjusted stroke length. This is clearly a disadvantage. However, the known arrangement has another disadvantage in that a cluster of pilot valves and trip switches surround the metering pump thereby adding to its complexity. This can be a serious problem with multi-head systems having a series of adjacent dispensing outlets. It also adds to the cost of manufacture and increases the difficulty of servicing and of maintaining hygene.

In machine control applications, the clustering of pilot valves and limit switches is also a common problem wherein barely sufficient room may be available at a cutting head, such as adjacent the chuck of a lathe, to install the control mechanism and to operate the machine in accordance with a predetermined sequence.

An object of the present invention is to simplify such control arrangements by avoiding the need for independent pilot valves, or their equivalents, and to provide a self-contained fluid operated control device.

A further object is to facilitate stroke adjustment of reciprocating means, such as a shaft attached to a metering pump, with respect to the generation of signal inputs and outputs for controlling a timed sequence of events.

The invention generally comprises a fluid operated control device comprising a first cylinder containing a first piston for reciprocal displacement between first and second locations at respective ends of the first cylinder. The first cylinder is provided with inlet and outlet means for supplying fluid to and from the first cylinder to cause displacement of the first piston. Valve means mounted at respective ends of the first cylinder have second and third cylinders housing respective second and third pistons. The second and third cylinders each have biasing means for urging the respective second or third piston towards a first position in the path of displacement of the first piston. The second and third pistons are thereby displaceable, in response to the first piston, to second positions. Each second and third cylinder is provided with a signal inlet and outlet which may be connected, for example, to pneumatic signal sources. The latter inlet and outlets thereby provide signal inputs and outputs respectively in accordance with the positions of the second and third pistons. The signal inlet communicates with the signal outlet when the respective second or third piston is in its first position and the signal inlet is isolated from the signal outlet when the respective second or third piston is in its second position. Exhaust means are provided on each second and third cylinder for releasing fluid when the respective second or third piston has been displaced to its second position in response to displacement of the first piston. The signal input and outputs of each valve are thereby useable to control the supply of fluid to the first cylinder and hence control displacement of the first piston.

The arrangement may be such that the signal inputs and outputs of each valve are cross connected through a further control valve so that the first piston continuously reciprocates between the valves at the ends of the first cylinder. This is useful for continuously operating a metering pump to fill carton with food which are passing intermittently beneath a filling head. Alternatively, the signal inlets and/or outlets may be selectively used such that the first piston travels to, and remains at the end of its stroke each time a signal is given. This would be useful where an indeterminate delay is required between the reciprocating strokes of the piston. The signal inputs and/or outputs may also be connected to delay means to delay the displacement of the first piston.

Preferably, the second and third pistons are of a stepped construction enabling a two stage pressure bias to be applied. For example, both stages of pressure bias are applied when the respective second or third piston is in its first position, but only a single stage of pressure bias is exerted when the respective second or third piston is moved from its first to its second position. This ensures that the final and slight displacement of the first piston at the end of its stroke is accomplished sharply and positively as the second stage bias changes to a first stage bias. This is useful when the control device is used to drive a metering pump, because greater volumetric accuracy is achieved when the metering piston is moved sharply or positively at the ends of its stroke.

The control device may be entirely pneumatically operated, a source or sources of compressed air being connected to the inlet and outlet of the first cylinder and the signal inlet and outlet of each valve. However, it is also envisaged that the first cylinder may itself define a metering section which is provided with, for example, liquid under pressure as a prime mover. In this case, the first piston and first cylinder operated as a double action pump.

In the preferred embodiment, the first piston is attached to a shaft which extends through the second piston in the valve means at the respective end of the first cylinder. A stroke adjusting rod extends through the third piston in the valve at the other end of the first cylinder. The stroke adjusting rod is not physically connected to the first piston whereby no independent adjustment is necessary to provide a signal output at the end of an adjusted stroke of the first piston. This is a considerable advantage in that the stroke length may be varied whilst the device is in operation and the first piston is being continuously reciprocated. The stroke adjuster may be adapted for automatic adjustment depending on the use to which the control device is put. Moreover, the stroke length can be rapidly changed (e.g. within 30 seconds) to a new preset value. This is advantageous over the normal means for controlling stroke length by means of adjusting the position or operation of micro-switches or pilot valves.

As the control device with its valves are entirely self-contained, i.e. there are no moving parts (with the exception of the stroke adjusting rod, when used) no guards are necessary which would normally be used with strikers for operating microswitches or pilot valves in prior art arrangements. Moreover, when the two stage pressure bias is employed, the second and third pistons are subjected to reduced bias on the second stage of bias resulting in a sharp completion of stroke with rapid and positive valve action. In the prior art, the main working piston acts against continually increasing bias when it is displaced towards a pilot valve this affects the end of stroke and valve action.

Other objects and advantages of the invention will become apparent from the description of the preferred embodiment with respect to the accompanying drawings, in which:

FIG. 1 is a section through a fluid operated control device in accordance with the invention, FIG. 2 is a schematic flow diagram showing a pneumatic circuit and valve structure connected to the device of FIG. 1, FIG. 3 illustrates an additional signal valve for the circuit of FIG. 2, FIG. 4 illustrates a modification of FIG. 3 to provide selective operation, and FIG. 5 illustrates a modification of FIG. 4 to provide delayed operation.

Referring to FIG. 1, a fluid operated device is shown for use with a metering pump of known construction. As the pump is of known construction and forms no part of the invention, it has not been illustrated in FIG. 1. However, it will be understood that the reciprocating shaft 1 is connected to a piston in a metering cylinder of the pump.

The control device of FIG. 1 includes a first cylinder 2 which houses a piston 3 displaceable between apertured end plates 4 and 5. The piston 3 is connected to the end of shaft 1 and is reciprocated by pressurized fluid, such as a source of compressed air, which is fed alternately to cylinder ports 6 and 7. The connection of ports 6 and 7 to a main air supply will be described later with reference to FIG. 2. Valve means 8 and 9 are mounted at respective ends of cylinder 2 for controlling the flow of pressurized fluid to ports 6 and 7 as described below.

Valve means 8 houses a piston 10 which is displaceable over a very small distance (for example, 15 to 25 thousandths of an inch). The small displacement occurs over the gap or space 11. As shown in FIG. 1, the piston 10 is urged towards a first position with the aid of a coil spring 12. Spring 12 is assisted, in operation, by a source of signal air pressure applied to annular regions 13 and 14 formed by steps in the cylindrical body of piston 10. The signal air pressure is applied to an inlet port 15 in the cylindrical body 16 of valve means 8. A passageway 44 of circular cross section communicates with the inlet port 15 and the annular region 13. A signal pressure outlet port 17 is provided in the body 16 for the purpose explained in connection with FIG. 2. The end plate 4 covers the open end of body 16 and defines an exhaust passageway 18. An axial passageway 19, of circular cross section, communicates with passageway 18. The outer end of passageway 19 faces a corresponding zone on the face of an annular region 20 of piston 10. Similarly, an axial passageway 21, of circular cross section, has an outlet which faces a corresponding zone on the face of the annular region 20 at a point diametrically opposite passageway 19. Passageway 21 is formed partly in body 16 and partly in the end plate 4. It communicates with the signal pressure outlet port 17. Piston 10 is provided with a series of ring seals 22, 23 and 24 located in respective annular grooves. It is also sealed by an O-ring 25 located in a corresponding annular groove in body 16.

Piston 10 is hollow and contains a stroke adjusting rod 26 which extends slightly from the inner face 27 of the end plate 4, as shown by reference 29. Rod 26 passes through an O-ring seal 28 located in a corresponding annular groove in the end plate 4. Rod 26 is releasably secured to piston 10 so that the projection 29, from face 27, can be adjusted. This adjustment is effected by means of a locking ring 30 which is mounted by threads 31 on the end of piston 10, and by a threaded extension 32 (of rod 26) which passes through a threaded collar 33. Collar 33 is attached to piston 10 by screws which are indicated by the broken line 34. A resilient annular pad 35 is located between the end face 36 of collar 33 and an apertured end face 37 of locking ring 30. Aperture 38 in the end of the locking ring is of a larger diameter than the threaded extension 32. The locking ring 30 may be released by tapping one of the two rods 39 which extends radially therefrom. The extent of the projection 29 is then adjusted by turning threaded extension 32 (e.g. by a knob, not shown, connected to its furthest end) until the desired extension is provided. The locking ring 30 is then retightened so as to clamp the threaded extension 32 in the desired position.

Valve means 9 is of a construction which is similar in many respects to that of valve means 8 with the main exception of shaft 1 replacing rod 26. Therefore, similar elements have been given similar reference numerals, but with a prime to indicate that they are part of valve means 9.

Regarding the exception, shaft 1 passes slidably through a bush 41 which is supported in the end of piston 10'. Spring 12' urges piston 10' towards the interior of cylinder 2 so that the end of piston 10' extends by a predetermined amount 29'.

The structure may be changed from the illustrated form without departing from the invention. In this connection, a nose piece (not shown) may be added as an integral part of, or be fastened to, the outer end wall of the valve body 16' of valve 9 over the shaft 1. The bush 41 and an adjacent O-ring 43, instead of being contained in the piston 10' as illustrated, would be contained in the nose piece at the outer end of the valve body. This provides good support over the extended shaft 1 without causing a bias on the piston 10' when working the shaft 1. Pressure air would then move between the piston 10' and the shaft 1 outwardly to the new location of the O-ring 43 in the nose piece (not shown) and balance the effective surface area presented to pressure buildup at both ends of the piston 3.

In operation, piston 3 is driven towards valve 9 by compressed air supplied to port 6. Piston 3 abuts the projecting end 29' of piston 10' and meets the opposition of spring 12'. As the piston 10' is moved away from the position shown, the signal air outlet port 17' communicates, through passageway 21' and across the annular face 20' with passageway 19' and hence is vented to atmosphere via passageway 18'. As port 17' communicates, across the annular face 13', with the signal air inlet port 15', the pressure acting on piston 10' is slightly relieved thereby reducing the opposition to movement of piston 3. Piston 3 thereby speeds up until ultimately the annular face 13' is arrested by the annular ledge (not shown due to the section of the drawing) extending arcuately on each side of passageways 44' and 42'. When piston 10' is in its second position namely, at the end of its stroke, the signal inlet port 15' is isolated from the signal outlet port 17'. The pressure at port 17' therefore drops, due to its connection with passageway 18', hence providing a zero pneumatic signal or vent to a valve as described in FIG. 2. The signal inlet 15' is at a pneumatic high level due to its isolation from outlet 17'. This air is applied to the annular face 14' which is abutted by the end of spring 12'.

The zero signal or vent on outlet 17' is used to cause air to be cut off from port 6 and to be supplied to port 7 as described with reference to FIG. 2. Piston 3 therefore starts to move in the opposite direction towards the end of the adjusting rod 26.

The operation of valve 8 is similar to that of valve 9 and the only main exception is that piston 3 strikes the end of rod 26 instead of the end of piston 10° as in valve 9.

Therefore, air is supplied from the signal inlets 15, 15' to the respective signal outlets 17, 17' until the piston 3 has almost reached the end of its stroke. When the piston 3 reaches the end of its stroke, the signal air to outlets 17, 17' is terminated and these outlets are vented to atmosphere. When a compressed air signal is present at outlets 17, 17', there is no substantial action on piston 10, 10' in opposition to the spring 12, 12' because the passageways 21, 21' have very small diameters and hence the pressure applied to the abutting annular face 20, 20' is very small.

Referring now to FIG. 2, the device of FIG. 1 is generally indicated by reference 45. A five-way spool valve 46 is connected as shown to the signal inlets 15, 15' and the signal outlets 17, 17'. Valve 46 is also connected to ports 6, 7. The circle with a concentric dot represents a supply of compressed air. This diagram has been included to show how the shuttle of valve 46 alternately connects a compressed air supply and an exhaust to ports 6, 7. This is represented by the full line and broken line arrows in valve 46. Similarly, the full line and broken arrows in valves 8, 9 represent the operation described above.

In the device shown by FIG. 1, the cross sectional area of the end face of the adjusting rod 26 is less than the cross sectional area of the annular face formed by bush 41 and piston 10'. This improves the final ejecting action of shaft 1, due to the two stage pressure bias which is exerted at the end of the stroke of piston 3 towards the valve 9. In both cases, however, there is a cushioning effect due to back pressure in front of piston 3 in the direction of displacement towards valve 8 or 9. This is advantageous in reducing noise when the device is in operation.

If required, an additional signal valve or valves may be added to the circuit of FIG. 2. FIG. 3 illustrates a position for one of these valves which comprises a spring loaded shuttle or spool which connects the air supply 15' to a signal outlet 47 when compressed air is supplied to valve 46. A similar signal valve may be connected between port 17 and valve 46.

The circuit shown in FIG. 2 provides continuous operation whereby the shaft 1 reciprocates continuously. However, selective operation may be achieved, as shown in FIG. 4, by connecting ports 15, 15' to a selector valve schematically illustrated at 48. The circuitry is otherwise the same as that shown in FIG. 2. However, in this case, the piston 3 reaches and remains at the end of its stroke until the valve 48 is operated to supply air selectively to the respective port 15 or 15'.

A delay device may also be used to delay the return stroke of the piston after reaching the end of its stroke. This is schematically illustrated in FIG. 5 and would simply include, for example, a known pneumatic delay device (such as a valve connected to a timer) inserted between the respective air supplies and ports 15, 15'.

The device of FIG. 1 is entirely pneumatically operated. However, it could be modified such that cylinder 2 defines a metering section for fluid products supplied to one or other or both of ports 6, 7. In the case of a double acting metering pump, ports 6, 7 would both be supplied with, for example, a liquid product, via a suitable known valving arrangement.

The scope of the invention is defined by the following claims:

What is claimed is:

1. A fluid operated control device comprising, a first cylinder containing a first piston for reciprocal displacement between first and second locations at respective ends of said first cylinder, said first cylinder being provided with inlet and outlet means for supplying fluid to and from said cylinder to cause displacement of said first piston; valve means mounted at respective ends of said first cylinder, one of said valve means having a second cylinder containing a second piston and the valve means at the other end having a third cylinder containing a third piston, said second and third cylinders each having first and second biasing means for urging the respective second and third pistons toward a first position in the path of displacement of said first piston, said second and third pistons being thereby alternatively displaced, in response to said first piston, to second positions, and each said second and third cylinders being provided with a signal inlet and outlet, said signal inlets and outlets providing signal inputs and outputs respectively in accordance with the positions of said second and third pistons, each said signal inlet communicating with the respective signal outlet when the respective piston is in its first position and each said signal inlet being isolated from the respective signal outlet when the respective piston is in its second position; a stroke adjusting means extending through the piston in one said valve means to adjust the stroke of said first piston while said first piston is in reciprocal displacement motion; and exhaust means provided on each said second and third cylinder for releasing fluid when the respective piston has been displaced to its second position in response to displacement of said first piston, whereby said signal inputs and outputs are useable to control the supply of fluid to said first cylinder and hence control displacement of said first piston, one of said first and second biasing means being a pressure biasing means that is relieved while the other biasing means is maintained while either of said second or third pistons is moved toward its second position in response to said first piston, said stroke adjusting means shifting its associated piston to relieve said pressure biasing for its associated piston.

2. A fluid operated device according to claim 1 wherein said signal inputs and outputs of each valve means are interconnected through other control valve means to effect continuous reciprocation between said valve means at the ends of said first cylinder by causing a driving force to said first piston at the corresponding end of its stroke.

3. A fluid operated device according to claim 1 wherein said signal inlets and outlets are connected to selector means such that said first piston can travel to, and remain at the end of its stroke each time a signal is given by said selector means.

4. A fluid operated device according to claim 1 wherein said signal inputs and outputs are connected to delay means for delaying the displacement of said first piston.

5. A fluid operated device according to claim 1 wherein said second and third pistons are of stepped construction enabling a two stage pressure bias to be applied.

6. A fluid operated device according to claim 1 wherein said first, second and third cylinders are connected to means for supplying compressed air.

7. A fluid operated device according to claim 1 wherein said first cylinder is connected to a source of fluid product under pressure, and wherein said second and third cylinders are connected to means for supplying compressed air.

8. A fluid operated control device comprising, a first cylinder containing a first piston for reciprocal displacement between first and second locations at respective ends of said first cylinder, said first cylinder being provided with inlet and outlet means for supplying fluid to and from said cylinder to cause displacement of said first piston; valve means mounted at respective ends of said first cylinder, the valve means at one end having a second cylinder housing a second piston and the valve means at the other end having a third cylinder housing a third piston, said second and third cylinders each having biasing means for urging the respective second and third pistons towards a first position in the path of displacement of said first piston, said second and third pistons being thereby alternatively displaced in response to said first piston, to second positions, and each said second and third cylinders being provided with a signal inlet and outlet, said signal inlets and outlets providing signal inputs and outputs respectively in accordance with the positions of said second and third pistons, each said signal inlet communicating with the respective signal outlet when the respective piston is in its first position and each said signal inlet being isolated from the respective signal outlet when the respective piston is in its second position, a stroke adjusting means extending through the piston in one said valve means to adjust the stroke of said first piston while said first piston is in reciprocal displacement motion; and exhaust means provided on each said second and third cylinder for releasing fluid when the respective piston has been displaced to its second position in response to displacement of said first pistion, whereby said signal inputs and outputs are useable to control the supply of fluid to said first cylinder and hence control displacement of said first piston, said first piston being attached to a shaft, said shaft extending through said second piston in said valve means at the respective end of said first cylinder.

9. A fluid operated device according to claim 8 wherein said stroke adjusting means is a rod that extends through said third piston in said valve means at the other end of said first cylinder.

10. A fluid operated device according to claim 9 wherein said rod is not physically connected to said first piston.

* * * * *